US011642764B2

(12) United States Patent
Friberg

(10) Patent No.: US 11,642,764 B2
(45) Date of Patent: May 9, 2023

(54) ELECTRIC TOOL ADAPTED TO PERFORM TIGHTENING OPERATIONS WHERE TORQUE IS DELIVERED IN PULSES

(71) Applicant: ATLAS COPCO INDUSTRIAL TECHNIQUE AB, Stockholm (SE)

(72) Inventor: John Robert Christian Friberg, Nacka (SE)

(73) Assignee: Atlas Copco Industrial Technique AB, Stockholm (SE)

( * ) Notice: Subject to any disclaimer, the term of this patent is extended or adjusted under 35 U.S.C. 154(b) by 0 days.

(21) Appl. No.: 17/867,725

(22) Filed: Jul. 19, 2022

(65) Prior Publication Data

US 2022/0355446 A1 Nov. 10, 2022

Related U.S. Application Data

(63) Continuation of application No. PCT/EP2021/050618, filed on Jan. 14, 2021.

(30) Foreign Application Priority Data

Jan. 29, 2020 (SE) ..... 2030027-3

(51) Int. Cl.
*B25B 21/02* (2006.01)
*B25B 23/147* (2006.01)

(52) U.S. Cl.
CPC ..... *B25B 21/02* (2013.01); *B25B 23/1475* (2013.01)

(58) Field of Classification Search
CPC ..... B25B 21/00; B25B 21/02; B25B 23/14; B25B 23/147; B25B 23/1475; F16L 5/08; F16L 5/14; H02G 3/088; H02G 3/22
See application file for complete search history.

(56) References Cited

U.S. PATENT DOCUMENTS 4,838,133 A * 6/1989 Dainin ..... B25B 21/02 81/463
4,920,836 A * 5/1990 Sugimoto ..... B25B 21/02 81/463

(Continued)

OTHER PUBLICATIONS

International Search Report issued by the European Patent Office acting as the International Searching Authority in relation to International Application No. PCT/EP2021/050618 dated Apr. 9, 2021 (3 pages).

(Continued)

*Primary Examiner* — Robert J Scruggs
(74) *Attorney, Agent, or Firm* — Robert P. Michal, Esq.; Carter, DeLuca & Farrell LLP

(57) ABSTRACT

An electric tool adapted to perform tightening operations where torque is delivered in pulses to tighten a screw joint. The electric tool including an electric motor drivingly connected to an output shaft. A processor and a memory storing software instructions that, when executed by the processor cause the electrical tool, retrieve a first power level parameter p1 indicating a first power level to be used for torque pulses up to a torque threshold. And retrieve a second power level parameter p2 indicating a second power level to be used for torque pulses above the torque threshold. Then control the speed of the electric motor, so that the electric tool provide torque pulses on the output shaft with the first power level p1 until the torque threshold is reached. And control the speed of the electric motor, so that the electric tool provide torque pulses on the output shaft with the second power level p2.

5 Claims, 3 Drawing Sheets

(56) References Cited

U.S. PATENT DOCUMENTS

| | | | | |
|---|---|---|---|---|
| 5,715,894 | A * | 2/1998 | Maruyama | B25B 23/1456 173/180 |
| 8,074,732 | B2 * | 12/2011 | Lehnert | B25B 23/0035 173/132 |
| 2010/0096155 | A1 * | 4/2010 | Iwata | B25B 21/02 173/217 |
| 2015/0090468 | A1 * | 4/2015 | Lars Elsmark | B25B 21/02 173/1 |
| 2015/0352699 | A1 | 12/2015 | Sakai et al. | |
| 2019/0168364 | A1 * | 6/2019 | Klotblixt | B25B 21/00 |
| 2020/0023501 | A1 | 1/2020 | Bandy et al. | |

OTHER PUBLICATIONS

Written Opinion of the International Searching Authority issued by the European Patent Office acting as the International Searching Authority in relation to International Application No. PCT/EP2021/050618 dated Apr. 9, 2021 (5 pages).

International Preliminary Report on Patentability issued by the European Patent Office acting as the International Searching Authority in relation to International Application No. PCT/EP2021/050618 dated May 3, 2022 (19 pages).

* cited by examiner

ELECTRIC TOOL ADAPTED TO PERFORM TIGHTENING OPERATIONS WHERE TORQUE IS DELIVERED IN PULSES

CROSS-REFERENCE TO RELATED APPLICATIONS

This application is a continuation of PCT International Application No. PCT/EP2021/050618 filed Jan. 14, 2021, which claims priority to Swedish Patent Application No. 2030027-3, filed Jan. 29, 2020, the disclosure of each of these applications is expressly incorporated herein by reference in their entirety.

TECHNICAL FIELD

The invention relates to an electric tool adapted to perform tightening operations where torque is delivered in pulses and a method for controlling an electric tool.

BACKGROUND

During a tightening operation where torque is delivered in pulses, it is desired to control the tightening such that a specific torque is installed into the join. It is also important to achieve high accuracy. For instance it is important that critical joints are tightened to the correct torque with high accuracy. Therefore electric tools are often adapted to tighten screw joints to a specific target value. It is also important that the joint are tightened rapidly, since the time used to produce an item also is important.

In order to achieve an accurate and rapid tightening the electric tool has to use the correct amount of power to achieve both a correct and rapid tightening. It is often hard to set the optimal amount of power, since accuracy and speed often are opposite conditions. If for instance a rapid tightening is desired there is a risk that the joint is tightened to hard. If an accurate tightening is desired the speed to complete the tightening is often low.

Hence, there exists a need for an improved electric tool that both can tighten joints accurately and rapidly.

SUMMARY

An object of the present disclosure is to provide an electric tool that both can tighten joints rapidly and to the correct target value.

In electric tools according to prior art pulses are created by applying a fixed current during a fixed time to a motor in the electric tool. Thus the pulses will have the same power during the entire tightening.

Thus for prior art pulse tools, only one power level is used for all pulses, even though the characteristics of the joint can vary during the tightening of the joint. Thus the speed and accuracy of the tightening is not optimized, since sometime the power that is used is too high and sometime the power that is used is too low.

One object of the present disclosure is to solve or at least mitigate the problem with optimized power of pulses during a tightening.

This object is achieved in accordance with a first aspect of the disclosure by an electric tool adapted to perform tightening operations where torque is delivered in pulses to tighten a screw joint. The electric tool comprising an electric motor drivingly connected to an output shaft. A processor and a memory storing software instructions that, when executed by the processor cause the electrical tool, retrieve at least first power level parameter p1 indicating a first power level to be used for torque pulses up to a torque threshold. And retrieve at least a second power level parameter p2 indicating a second power level to be used for torque pulses above the torque threshold. Thereafter retrieve the torque threshold indicating the torque up to which the first power level should be used.

And next control the speed of the electric motor, so that the electric tool provide torque pulses on the output shaft with the first power level p1 until the torque threshold is reached. And control the speed of the electric motor, so that the electric tool provide torque pulses on the output shaft with the second power level p2.

According to the first aspect, the electric power tool provides an inventive solution to the concerns described above by allowing a user of the power tool to set different power levels to be used during different stages of the tightening. Thus the user can adjust the power level to for instance be high in the beginning of a tightening up to a certain torque threshold. And set the power level to a lower value above a certain torque threshold, so that the tightening is performed with a lower power close to the target torque.

Thus by taking the characteristics of the joint into consideration when setting the power for the pulses up to a certain torque threshold it is possible to adapt the power so that the joint is tightened as fast as possible up to a certain torque threshold. It is also possible to achieve a more accurate tightening since the power can be set to a lower value close to the target torque. An advantage with this approach, is that the power for the pulses can be set to fit different stages of the tightening. Thus it is possible to achieve higher accuracy and speed for the tightening, since the power for the pulses can be set by the user depending on the condition of the joint.

According to one embodiment, the first and second power level parameters p1 and p2 are expressed as percentage of the maximum power level. Herby the power, can be easily be adjusted to for instance the target torque or any other target value such that the power is reduced in case the torque is close to the target torque. And the power can easily be increased in case the torque is far from the target torque or any other torque value. Thus ensuring the target does not reach above the target torque. The pulses can also be set to the user's desire of which type of tightening that is desired. A faster less accurate tightening or a slower more accurate tightening.

According to one embodiment, the pulses are provided by a hydraulic pulse unit coupled to the electric motor, the hydraulic pulse unit intermittently couples the electric motor via a hydraulic coupling mechanism to the output shaft. Thus the idea according to the present disclosure can be used in an electric tool comprising a hydraulic pulse unit. Thereby providing the possibility to set the power of pulses during a tightening with an electric hydraulic pulse tool. An advantage is optimized power level during whole tightening.

According to one embodiment, the speed of the electric motor is controlled so that the electric motor is driven in a pulsed manner to provide pulses on the output shaft. In this embodiment the pulses are provided by acceleration the motor within the inherent play that exist in the gearbox between the motor and the output axel. In other embodiment the motor is accelerated within a certain play unit that is provided between the motor and the output axel. Hereby rotational energy is built up in the tool. This rotational energy is then transferred to the screw as a torque pulse, when the play between the motor and the output axle is closed.

In accordance with a second aspect the disclosure relates to a method for controlling an electric tool where tightening operations are performed by delivering pulses to tighten a screw joint. The electric tool comprising, an electric motor drivingly connected to an output shaft. The method comprising the steps of, retrieving at least first power level parameter p1 indicating a first power level to be used for torque pulses up to a torque threshold. Retrieving at least a second power level parameter p2 indicating a second power level to be used for torque pulses above the torque threshold. Retrieving a torque threshold parameter indicating the torque up to which the first power level should be used. Controlling the speed of the electric motor, so that the electric tool provide torque pulses on the output shaft with the first power level p1 until the torque threshold is reached.

Advantages of embodiments according to the second aspect are the same, as for the first aspect and have been described above in relation to the embodiments of the first aspect.

BRIEF DESCRIPTION OF THE DRAWINGS

The invention will now be described in more detail and with reference to the accompanying drawings, in which.

DETAILED DESCRIPTION

Figure 1:
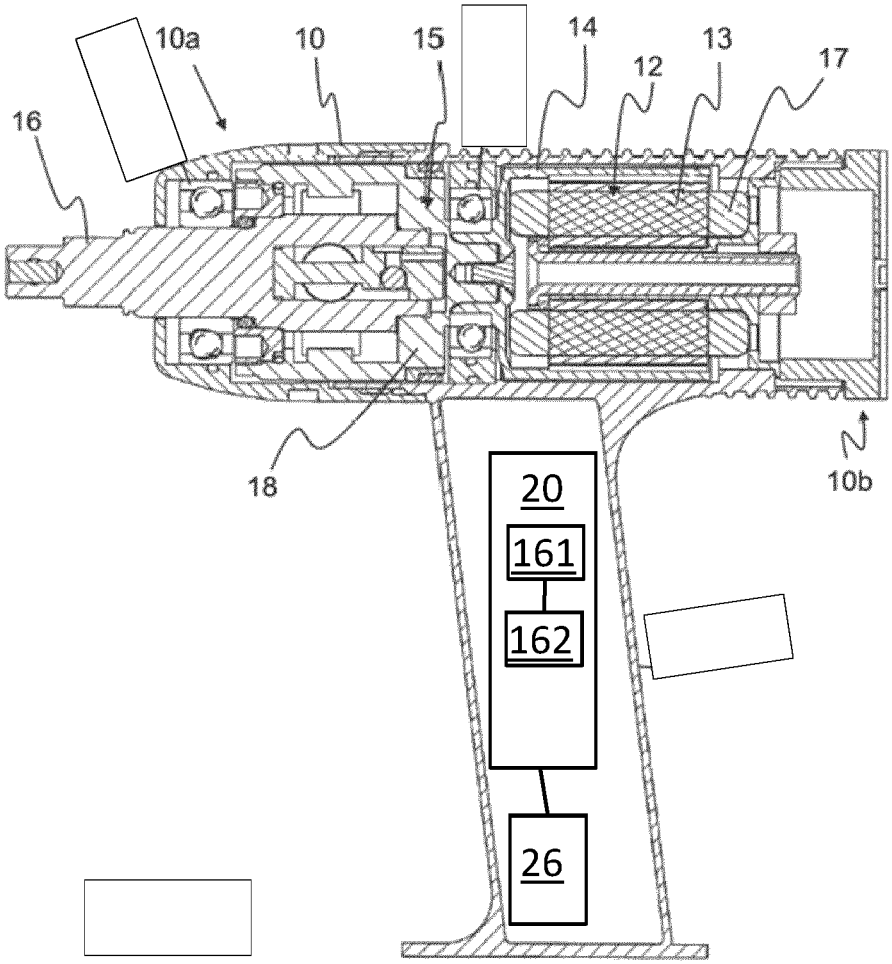
FIG. 1 shows a longitudinal section through the electric tool according to an exemplary embodiment of the present disclosure.

Aspects of the present disclosure will be described more fully hereinafter with reference to the accompanying drawings. The device, method and computer program disclosed herein can, however, be realized in many different forms and should not be considered as being limited to the aspects set forth herein. Like numbers in the drawings refer to like elements throughout.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

FIG. 1 depicts an exemplary embodiment of an electric tool 10 in accordance with an embodiment of the present disclosure. The electric tool 10 further comprising a front end 10*a* and a back end 10*b*. The electric tool 10 further comprises a motor 12. The motor 12 comprising a rotor 14 that is arranged to rotate with respect to a stator 13. An output shaft 16 is arranged at the front end 10*a* of the housing 10. The electric tool 10, according to the illustrated embodiment, further comprises a hydraulic pulse unit 15 which is coupled to the electric motor 12. The hydraulic pulse unit 15 intermittently couples the inertia drive member 18 via a hydraulic coupling mechanism to the output shaft 16. The function of a hydraulic pulse unit 15 is well known to a person skilled in the art and is not described in detail in this application. A more detailed description of the function of a pulse unit is described in the international patent application WO 91/14541.

The electric tool 10 further comprise a processor 20 arranged to control the electric motor 12. The electric tool 10 also comprises a memory 26 containing instructions executable by the processor 20.

The inventor has realised that higher accuracy and faster tightening can be achieved by allowing the user to set the power of the pulses for different stages of the tightening.

An advantage with this solution is that the power can be set to be optimized during different stages of the tightening to achieve high accuracy and speed. Thus one aspect of the present disclosure relates to an electric tool where the memory 26 containing instructions which when run in the electrical pulse tool causes the electrical tool to control the speed of the electric motor 12, so that the electric tool 10 provide torque pulses on the output shaft 16 with the first power level p1 until the torque threshold is reached.

According to one exemplary embodiment the electric tool comprises an angle sensor (not shown) arranged to determine the position of the motor 12. According to one exemplary embodiment the angle sensor is positioned between the motor 12 and the inertia drive member 18. The angle senor can however be located on other places in the electric tool.

According to one exemplary embodiment the power of the pulses are determined by providing a current to the electric motor 12 during a predetermined time interval. According to another exemplary embodiment the power of the pulses are provided by providing a current to the electric motor 12 during a predetermined time interval and at the same time monitor the speed of the motor 12. By providing a current to the electric motor 12 during a predetermined current on time interval and at the same time monitor the speed of the motor 12 a certain determined power can be achieved. If a desired power is not reached at a certain angle of the motor 12, a new current pulse can be provided to the motor 12. This in order to make sure that the desired power of the motor is obtained at the moment the motor 12 couples to the output shaft 16.

According to another exemplary embodiment the power is constantly measures and the current feed is controlled so that the power is reached at the moment the inertia drive member 18 couples to the output shaft 16 and the pulse is provided to the screw being tightened. According to yet another exemplary embodiment the power of the motor 12 is controlled by continuously monitor the actual position of the motor 12 and take the position into account when determining the power.

Referring back to FIG. 1, the processor 20 is a Central Processing Unit, CPU, microcontroller, Digital Signal Processor, DSP, or any other suitable type of processor capable of executing computer program code. The memory 26 is a Random Access Memory, RAM, a Read Only Memory, ROM, or a persistent storage, e.g. a single or combination of magnetic memory, optical memory, or solid state memory or even remotely mounted memory.

According to one aspect, the disclosure further relates to the above mentioned computer program, comprising computer readable code which, when run on the electric tool causes the electric tool to perform any of the aspects of the disclosure described herein.

According to one aspect of the disclosure the processor 20 comprises one or several of:

- a retrieve module 161 adapted retrieve at least first power level parameter p1 indicating a first power level to be used for torque pulses up to a torque threshold, retrieve at least a second power level parameter p2 indicating a second power level to be used for torque pulses above the torque threshold and retrieve the torque threshold indicating the torque up to which the first power level should be used;
- a control module 162 adapted control the speed of the electric motor 12, so that the electric tool 10 provide torque pulses on the output shaft 16 with the first power level p1 until the torque threshold is reached and control the speed of the electric motor 12, so that the electric tool 10 provide torque pulses on the output shaft 16 with the second power level p2.

The control modules 161 and 162 are implemented in hardware or in software or in a combination thereof. The modules 161 and 162 are according to one aspect implemented as a computer program stored in the memory 26 which run on the processor 20. The electric tool is further configured to implement all the aspects of the disclosure as described herein.

Figure 2:
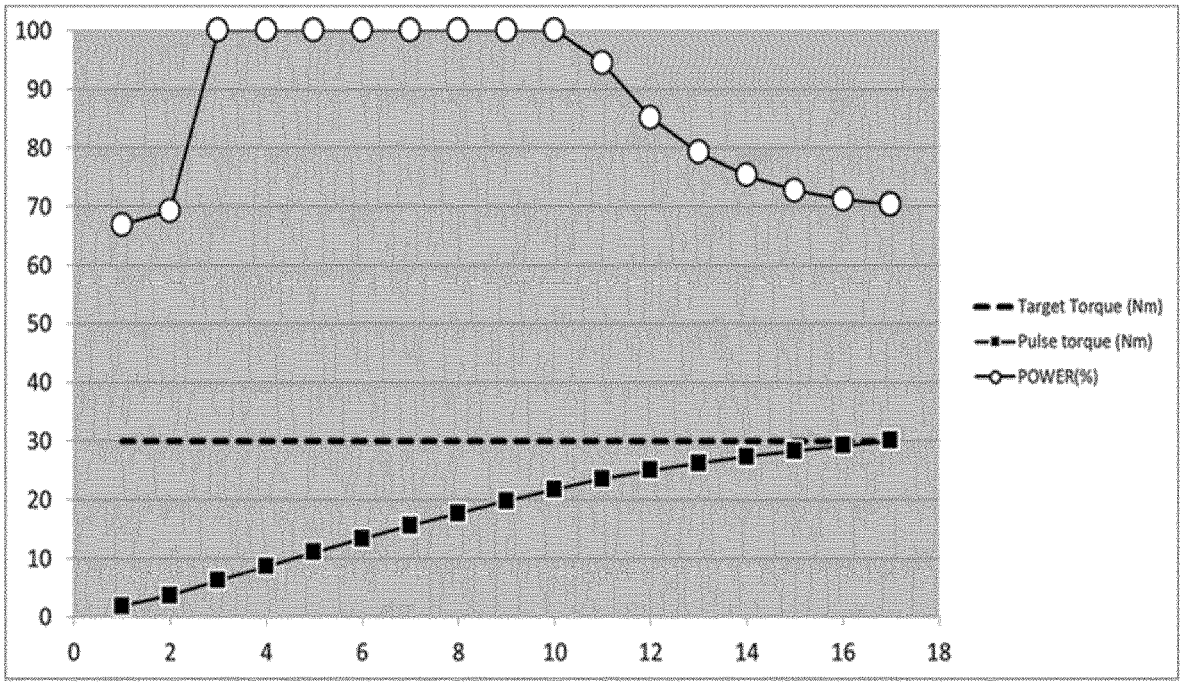
FIG. 2 shows example diagram of torque pulses according to an exemplary embodiment of the present disclosure.

Now turn to FIG. 2, which shows one example of a number of pulses in a tightening performed by the electric tool 1 according to the present disclosure. FIG. 2 comprises three graphs. The graph at the top illustrates the power of the pulses. The graph in the middle illustrates the target torque for the tightening. And the graph at the bottom illustrates the torque t (pulse torque) of the pulses n. As can be seen in the top graph of FIG. 2, the power of the pulses vary during the tightening.

In the illustrated tightening the power of the pulses in the beginning are low. The electric tool provides torque pulses on the output shaft 16 with the first power level p1, since the torque threshold has not been reached.

Then the power level of the pulses increases since the torque threshold has been reaches and the user has set the power level to a higher value after the torque threshold. As the torque of the pulses get closer to the target torque, the power of the pulses decreases since the user has set the power of the pulses to an even lower value in order to reach the target torque with good accuracy.

As can be seen from FIG. 2, the electric tool is operative to repeat the pulses until a parameter value associated with the tightening of a screw joint has been reached. In an exemplary embodiment of the electric tool the parameter value associated with the tightening of a screw joint is torque. In yet another exemplary embodiment of the electric tool the parameter value associated with the tightening of a screw joint is angle.

The present disclosure also relates to a computer-readable storage medium, having stored there on a computer program which, when run in the electrical pulse tool, causes the electrical pulse tool to be operative as described above.

According to one exemplary embodiment, when the above-mentioned computer program code is run in the processor 20 of the electric tool it causes the electric tool to be operative as described above.

Figure 3:
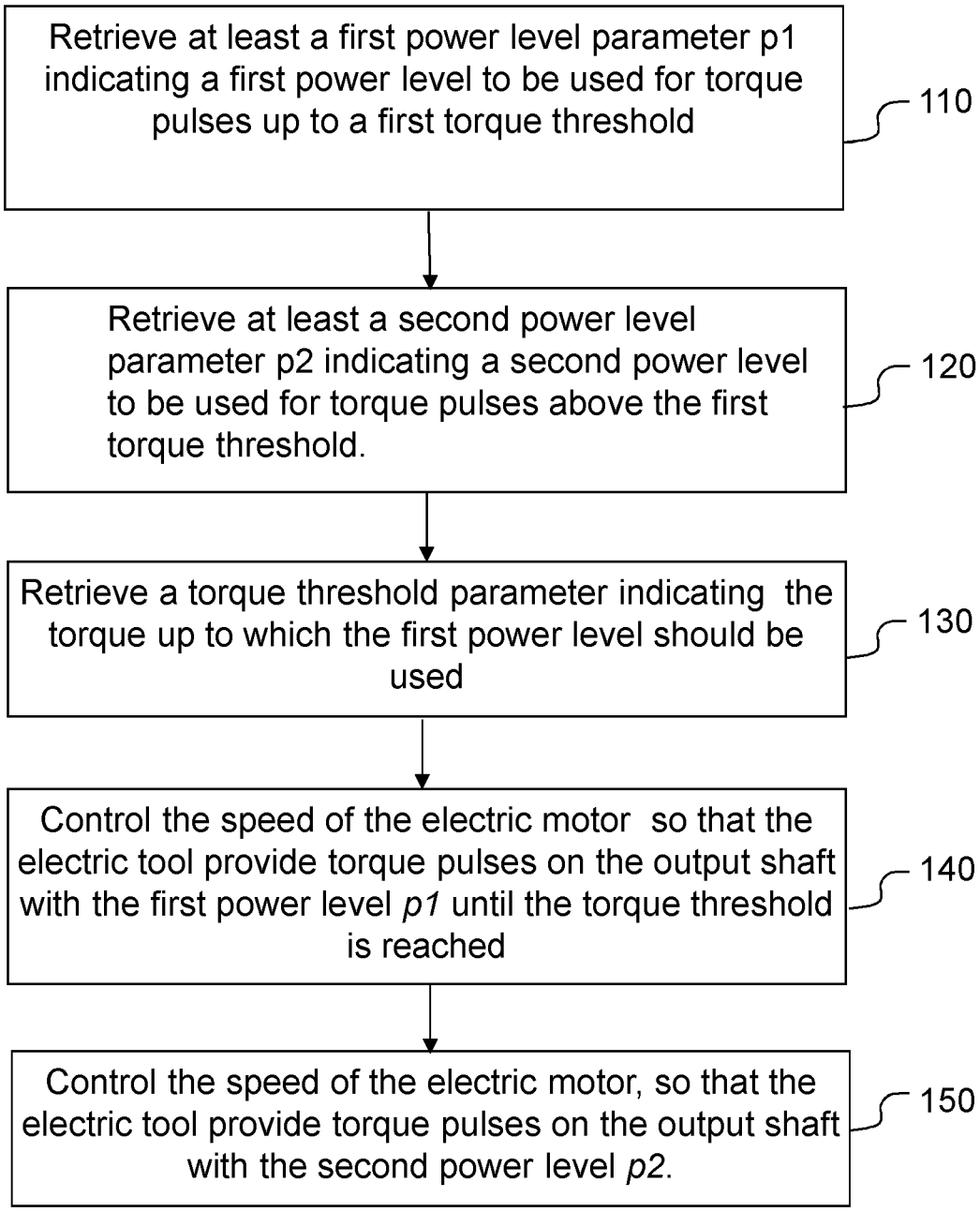
FIG. 3 illustrates a flow chart according to an exemplary embodiment of the present disclosure.

FIG. 3 illustrates a flow chart of a method for controlling an electric tool where tightening operations are performed by delivering pulses to tighten a screw joint. The electric tool 10 comprising an electric motor 12 drivingly connected to an output shaft 16. The method comprising a step 110 of retrieving at least first power level parameter p1 indicating a first power level to be used for torque pulses up to a torque threshold. In a step 120, retrieve at least a second power level parameter p2 indicating a second power level to be used for torque pulses above the torque threshold. Next in a step 130, retrieve the torque threshold indicating the torque up to which the first power level should be used. Thereafter in a step 140, control the speed of the electric motor 12, so that the electric tool 10 provide torque pulses on the output shaft 16 with the first power level until the torque threshold is reached. Then, in a step 150, control the speed of the electric motor 12, so that the electric tool 10 provide torque pulses on the output shaft 14 with the second power level p2.

According to another exemplary embodiment, wherein the first and second power level parameters p1 and p2 are expressed as percentage of the maximum power level. In another exemplary embodiment of the method, the pulses are provided by a hydraulic pulse unit 13 coupled to the electric motor 12, the hydraulic pulse unit 15 intermittently couples the electric motor 12 via a hydraulic coupling mechanism to the output shaft 16. In another exemplary embodiment of the speed of the electric motor 12 is controlled so that the electric motor is driven in a pulsed manner to provide pulses on the output shaft 16.

The invention claimed is:

1. An electric tool adapted to perform tightening operations where torque is delivered in pulses to tighten a screw joint, the electric tool comprising: an electric motor drivingly connected to an output shaft, wherein the pulses are provided by a hydraulic pulse unit coupled to the electric motor, the hydraulic pulse unit intermittently couples the electric motor via a hydraulic coupling mechanism to the output shaft, or wherein the speed of the electric motor is controlled so that the electric motor is driven in a pulsed manner to provide pulses on the output shaft, the electric tool further comprising a processor; and a memory storing software instructions that, when executed by the processor cause the electrical tool to:

retrieve at least first power level parameter p1 indicating a first power level to be used for torque pulses up to a torque threshold;

retrieve at least a second power level parameter p2 indicating a second power level to be used for torque pulses above the torque threshold;

retrieve the torque threshold indicating the torque up to which the first power level should be used;

control the speed of the electric motor, so that the electric tool provides torque pulses on the output shaft with the first power level p1 until the torque threshold is reached; and control the speed of the electric motor, so that the electric tool provides torque pulses on the output shaft with the second power level p2.

2. The electric tool according to claim 1, wherein the first and second power level parameters p1 and p2 are expressed as percentage of the maximum power level.

3. A method for controlling an electric tool where tightening operations are performed by delivering pulses to tighten a screw joint, the electric tool comprising: an electric motor drivingly connected to an output shaft, wherein the pulses are provided by a hydraulic pulse unit coupled to the electric motor, the hydraulic pulse unit intermittently couples the electric motor via a hydraulic coupling mechanism to the output shaft, or wherein the speed of the electric motor is controlled so that the electric motor is driven in a pulsed manner to provide pulses on the output shaft, the method comprising the steps of:

retrieving at least first power level parameter p1 indicating a first power level to be used for torque pulses up to a torque threshold;

retrieving at least a second power level parameter p2 indicating a second power level to be used for torque pulses above the torque threshold;

retrieving the torque threshold indicating the torque up to which the first power level should be used;

controlling the speed of the electric motor, so that the electric tool provides torque pulses on the output shaft with the first power level p1 until the torque threshold is reached; and controlling the speed of the electric motor, so that the electric tool provides torque pulses on the output shaft with the second power level p2.

4. The method according to claim 3, wherein the first and second power level parameters p1 and p2 are expressed as percentage of the maximum power level.

5. A computer readable storage medium storing software instructions on a memory which are executable by a processor and which cause an electrical tool to perform tightening operations where torque is delivered in pulses to tighten a screw joint, the electric tool comprising: an electric motor drivingly connected to an output shaft, wherein the pulses are provided by a hydraulic pulse unit coupled to the electric motor, the hydraulic pulse unit intermittently couples the electric motor via a hydraulic coupling mechanism to the output shaft, or wherein the speed of the electric motor is controlled so that the electric motor is driven in a pulsed manner to provide pulses on the output shaft, and wherein when the software instructions are executed by the processor, the software instructions cause the electrical tool to:

retrieve at least a first power level parameter p1 indicating a first power level to be used for torque pulses up to a torque threshold;

retrieve at least a second power level parameter p2 indicating a second power level to be used for torque pulses above the torque threshold;

retrieve the torque threshold indicating the torque up to which the first power level should be used;

control the speed of the electric motor, so that the electric tool provides torque pulses on the output shaft with the first power level p1 until the torque threshold is reached; and control the speed of the electric motor, so that the electric tool provides torque pulses on the output shaft with the second power level p2.

* * * * *